US007234508B2

(12) United States Patent
Vestman et al.

(10) Patent No.: US 7,234,508 B2
(45) **Date of Patent: *Jun. 26, 2007**

(54) MOULD FOR CONTINUOUS CASTING OF METAL STRIPS

(75) Inventors: Bertil Vestman, deceased, late of Västerås (SE); by Angela Vestman, legal representative, Hemdalsvägen (SE); by Susanne Karlsson, legal representative, Gnejsvägen (SE); Sture Östlund, Norrköping (SE)

(73) Assignee: Luvata Oy, Espoo (FI)

( * ) Notice: Subject to any disclaimer, the term of this patent is extended or adjusted under 35 U.S.C. 154(b) by 0 days.

This patent is subject to a terminal disclaimer.

(21) Appl. No.: 10/500,172

(22) PCT Filed: Dec. 18, 2002

(86) PCT No.: PCT/FI02/01037

§ 371 (c)(1),
(2), (4) Date: Jun. 13, 2005

(87) PCT Pub. No.: WO03/055622

PCT Pub. Date: Jul. 10, 2003

(65) Prior Publication Data

US 2006/0016577 A1 Jan. 26, 2006

(30) Foreign Application Priority Data

Dec. 28, 2001 (FI) ..... 20012583

(51) Int. Cl.
*B22D 11/04* (2006.01)
*B22D 11/124* (2006.01)

(52) U.S. Cl. ..... 164/418; 164/443

(58) Field of Classification Search ..... 164/418, 164/459, 485, 443

See application file for complete search history.

(56) References Cited

U.S. PATENT DOCUMENTS

| | | | | |
|---|---|---|---|---|
| 3,435,881 | A | 4/1969 | Smith et al. | 164/283 |
| 3,519,062 | A | 7/1970 | Wertli | 164/283 |
| 3,809,148 | A | 5/1974 | Pulsifer | 164/283 |
| 7,004,226 | B2 * | 2/2006 | Ostlund et al. | 164/418 |

FOREIGN PATENT DOCUMENTS

| | | |
|---|---|---|
| GB | 2 034 218 | 6/1980 |

* cited by examiner

*Primary Examiner*—Kuang Y. Lin
(74) *Attorney, Agent, or Firm*—Morgan & Finnegan, LLP

(57) ABSTRACT

A mould for continuously casting metal strips comprises a pair of side walls (11) on opposite sides of an open-ended mould cavity (C) having an entrance end (E) for continuously receiving molten metal and an exit end (D) for continuously discharging a moving solidified strip (D) formed from the molten metal. Each mould side wall (11) includes a graphite block (13) formed of a stack of a multiplicity of elongate graphite laminae (16) having opposite faces (16A) and inner edges (16B), said inner edges (16B) jointly forming a surface (16A) directed toward the mould cavity (C). The mould further comprises a cooling system associated with each graphite block (13) and including coolant tubes (15) extending through the stack transversely to said opposite faces (16A) of the graphite laminae (16) forming the stack.

7 Claims, 3 Drawing Sheets

MOULD FOR CONTINUOUS CASTING OF METAL STRIPS

BACKGROUND OF THE INVENTION

This invention relates to a mould for continuous casting of metal strips and more particularly to a continuous-casting mould of the kind comprising a pair of mould side walls on opposite sides of an open-ended mould cavity having an entrance end for continuously receiving molten metal and an exit end for continuously discharging a moving solidified strip formed from the molten metal, each said mould side wall including a graphite block, and further comprising a cooling system associated with each graphite block and including coolant tubes contacting the graphite block.

In the art of continuous casting of metals, especially in the continuous casting of non-ferrous metals or alloys, such as copper or copper base alloys, it is common practice to use a casting mould in which the walls of the open-ended mould cavity are formed by graphite lining plates, because graphite has advantageous lubricating properties and a fairly high thermal conductivity. These properties are highly desirable, firstly because low friction between the mould cavity walls and the moving solidified strip is essential and secondly because high thermal conductivity is required to permit efficient cooling of the mould and thus rapid solidification of the molten metal continuously fed into the mould cavity.

U.S. Pat. No. 3,519,062 and U.S. Pat. No. 3,809,148 A show examples of moulds for continuous casting of metal strips in which the inner faces of the side walls of the mould cavity are covered by thin lining plates of graphite. On the side directed away from the mould cavity, the graphite lining plates engage and are supported by backing and cooling members of metal. These backing and cooling members not only support and protect the graphite lining plate but also serve as cooling jackets through which a liquid coolant is passed to carry away heat from the mould cavity via the graphite lining plates.

It is also known, although not common practice, to form the inner faces of the mould side walls from thick graphite blocks or slabs and essentially dispensing with the conventional backing and cooling members. Thus, GB 2 034 218 A discloses a continuous-casting mould of the kind initially indicated, in which the horizontal mould cavity is defined by a pair of heavy solid graphite blocks which are placed one on top of the other and provided with mould cavity defining recesses in their confronting inner faces. An array of flattened coolant tubes of metal are urged against the outer faces of the blocks to be held in close contact with the blocks to carry off heat transmitted from the mould cavity across the thickness of the graphite blocks.

BRIEF SUMMARY OF THE INVENTIONS

An object of the invention is to provide an improved continuous-casting mould of the kind indicated initially which can be produced economically and is capable of efficiently cooling the molten metal in the mould cavity.

In accordance with the invention there is provided a mould for continuously casting metal strips, comprising a pair of mould side walls on opposite sides of an open-ended mould cavity having an entrance end for continuously receiving molten metal and an exit end for continuously discharging a moving solidified strip formed from the molten metal, each said mould side wall including a graphite block, and further comprising a cooling system associated with each graphite block and including coolant tubes contacting the graphite block, characterised in that the graphite block of each of said mould side walls is formed of a stack of a multiplicity of elongate graphite laminae having opposite faces and inner edges, said inner edges jointly forming a surface directed toward the mould cavity, and in that the coolant tubes extend through the stack transversely to said opposite faces of the graphite laminae forming the stack.

The laminated construction of the graphite block lends itself to a simple and economical production. Before the graphite laminae are stacked they are formed with apertures for receiving the coolant tubes, e.g. by punching. Then they are stacked by sliding them over the tubes. When the stacking is completed, the stack, which thus encloses the tubes, is compacted by the application of opposing forces to the ends of the stack to force the laminae into close face-to-face contact with one another and at the same time bring about a close contact between the laminae and the coolant tubes.

Preferably, a pair of metal end members are applied to the ends of the stack in face-to-face engagement with the outer face of respective ones of the outermost graphite laminae of the stack. The coolant tubes are preferably received on the end members. In this manner, the laminae forming the stack are securely held together by the tubes and the end members so that the assembly formed by the stack, the coolant tubes and the end members can be easily handled as a unit and the faces of the stack can be machined to become smooth.

A particularly efficient heat transfer from the mould cavity to the coolant passing through the coolant tubes is obtained by forming the stack from laminae made from compacted graphite flakes oriented so as to be generally parallel to the opposite faces of the graphite laminae. With graphite laminae so made, the heat conductivity in planes parallel to the faces of the laminae is considerably higher than the heat conductivity in the direction perpendicular thereto.

BRIEF DESCRIPTION OF THE DRAWINGS

The invention will be described in greater detail below with reference to the accompanying drawings in which an embodiment of the continuous-casting mould according to the invention is diagrammatically illustrated.

DETAILED DESCRIPTION OF THE PREFERRED EMBODIMENTS

Figure 1:
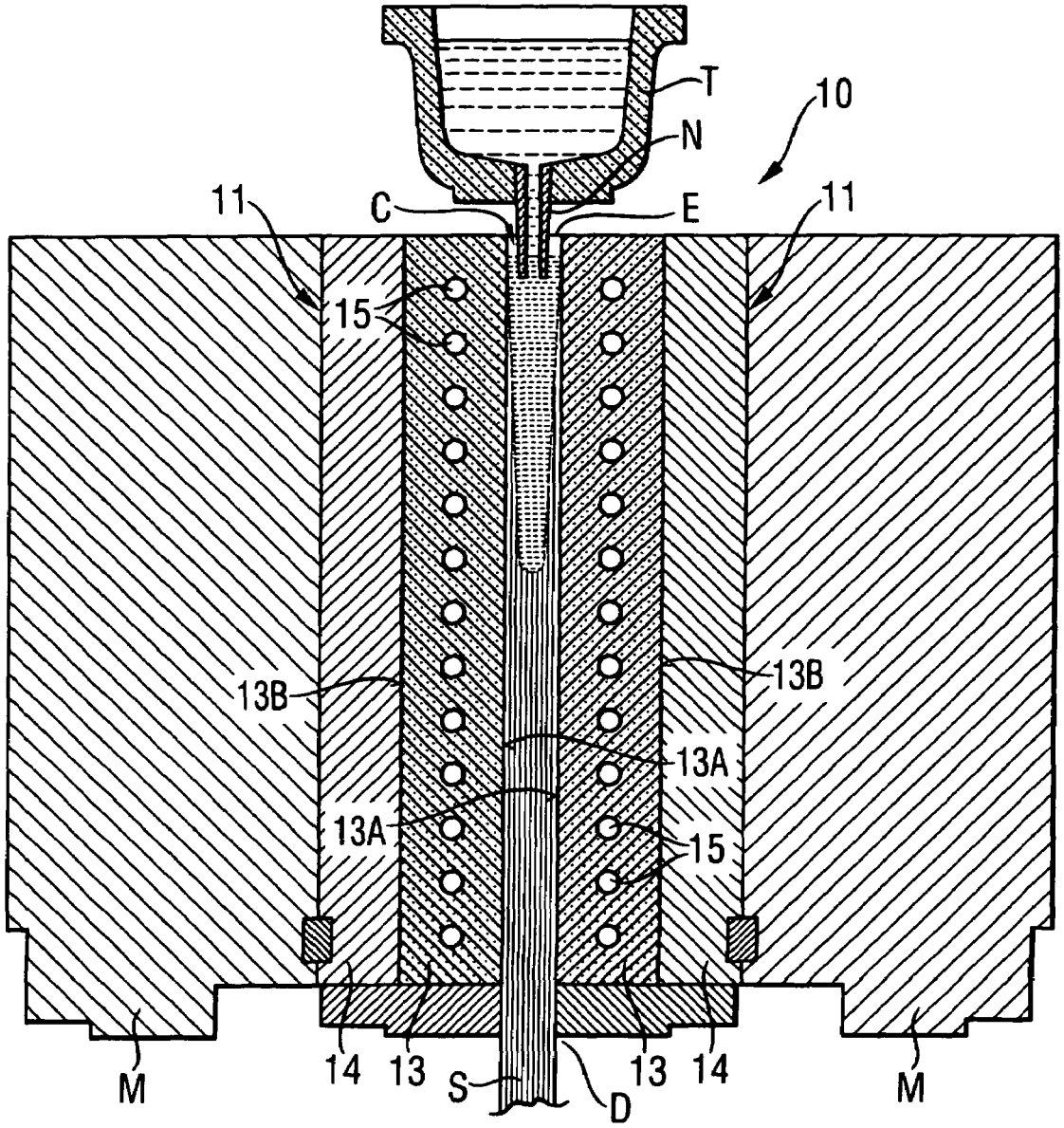
FIG. 1 is a view in vertical section along line I—I of FIG. 1 illustrating an example of a continuous-casting mould embodying the invention, the mould being shown with a tundish and strip that is being cast.

In the embodiment of the invention shown by way of example in the drawings, the continuous-casting mould 10 according to the invention is used for continuous vertical casting of metal strips. As will be appreciated, however, the invention is not limited to vertical casting; the inventive concept is equally well applicable to horizontal casting.

As best shown in FIG. 1, and as is well known in the art, molten metal is continuously poured from a tundish T into a generally parallelepipedal mould cavity C which extends vertically through the mould 10 and is open at the top and at the bottom of the mould. The molten metal in the tundish T is poured through a nozzle N into the upper or entrance end E of the mould cavity C where it forms a relatively stationary meniscus covered by a liquid flux. During its passage from the entrance end E to the lower or exit end D of the mould cavity C the molten metal is cooled by the mould to form a solidified strand S, which is in this case a strip and thus of a width that is a large multiple of the thickness.

Figure 2:
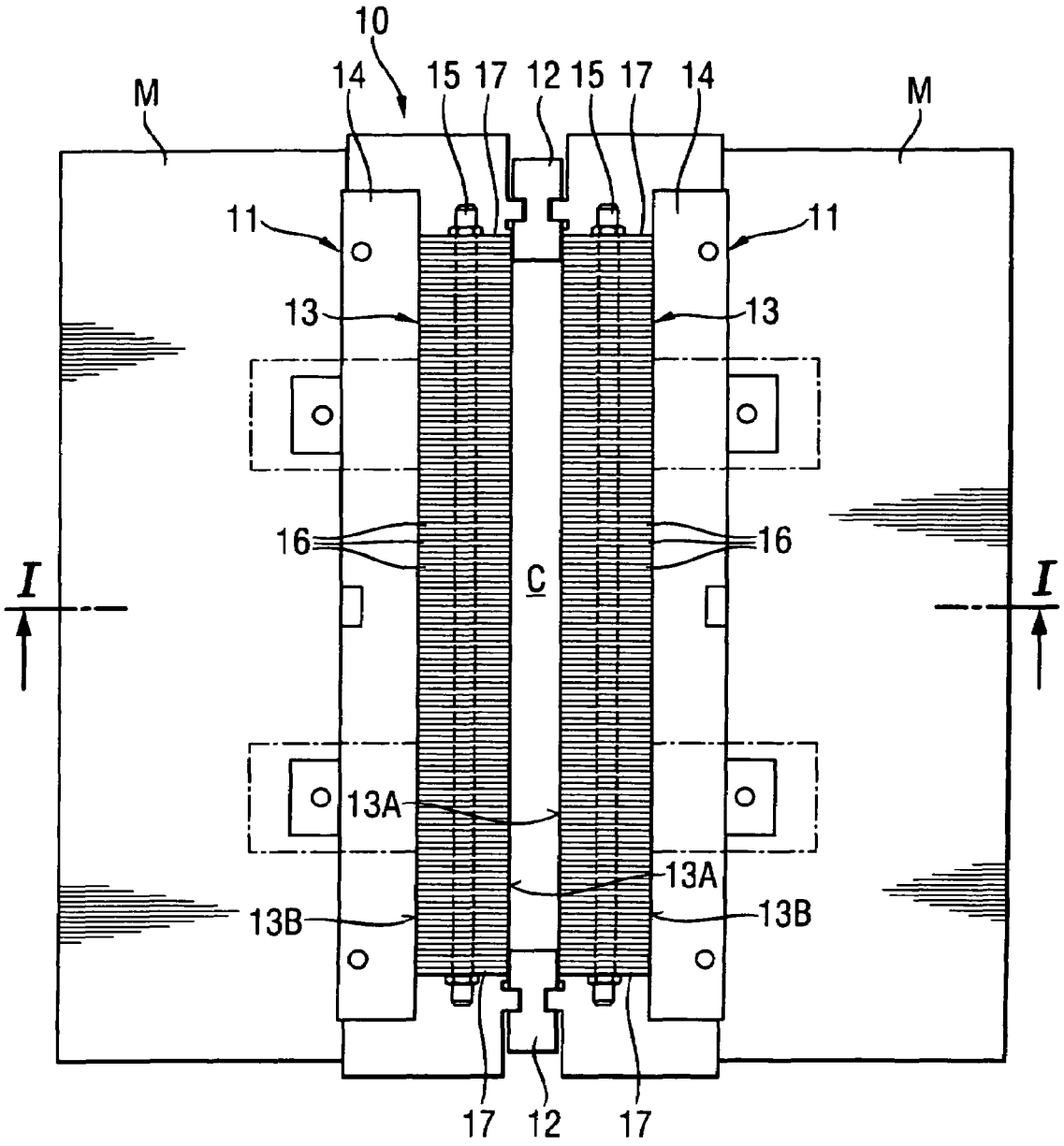
FIG. 2 is a plan view of the mould shown in FIG. 1, the tundish shown in FIG. 1 being omitted.

In operation, the mould 10 is mounted between a pair of mounting blocks M of a casting machine, which may be of conventional design. The mould proper comprises a pair of spaced-apart side walls, generally designated by 11, and a pair of end walls 12 formed of a pair of graphite bars and bridging the gap between the confronting inner sides of the side walls 11 so that the side and end walls 11, 12 jointly define the mould cavity C. FIG. 2 clearly shows the rectangular shape of the mould cavity C as viewed in the direction the cast metal moves through the passage formed by the mould cavity.

The side walls 11 are substantially identical in design. Each side wall comprises two main parts, namely a graphite slab or block 13 one face of which, the inner face 13A, is directed toward the mould cavity C and the opposite or outer face is directed away from the mould cavity, and a backing plate 14 which is secured to the mounting blocks M and supports and protects the graphite block 13. The backing plate 14 covers the entire outer face of the graphite block 13 and also engages the ends thereof. The graphite block 13 and its construction is unique and will be described in detail below, whereas the backing plate 14 may be of a substantially conventional design and need not be further described.

Associated with each side wall 11 is a cooling system which is largely conventional except for a part thereof. That part is included in the graphite block 13 and comprises an array of parallel, coolant tubes 15 of metal, such as copper. Other parts (not shown) of the system include means incorporated in the backing plates 14 for passing a liquid coolant through the graphite block 13. As shown in the drawings, the tubes extend horizontally—that is, transversely to the direction in which the cast metal moves through the mould cavity C—between opposite ends of the graphite block 15 along a vertical plane approximately centrally between the vertical large faces 13A, 13B of the graphite block 13.

The graphite block 13 of each side wall 11 is formed of a large number of thin strip-like rectangular elongate thin (thickness e.g. about 1 mm) graphite sheets or laminae 16 which are stacked with their broad surfaces or faces 16A in engagement with one another and their narrow longitudinal surfaces or edges 16B jointly forming the broad sides or faces 13A, 13B of the parallelepipedal slab-like straight stack or graphite block 13 so formed. The inner face 13A of the graphite block 13 mounted in the mould 10 forms one of the sides of the mould cavity C.

Preferably, the laminae 16 are made from flaky graphite, that is, graphite made up essentially of compacted flakes which are oriented such that they extend in planes substantially parallel to the faces of the graphite sheets from which the laminae are cut. Graphite sheets (foils and plates) that kind are readily available as commercial products. A particular attraction of such graphite sheets in the context of the present invention is that their thermal conductivity in directions parallel to the faces is considerably better than their thermal conductivity perpendicular to the faces. Examples of commercially available graphite sheet products that are suitable for the graphite block according to the invention are marketed by Sigri Elektrografit GmbH, Meitingen bei Augsburg, Germany, under the designations SIGRAFLEX-F (foils) and SIGRAFLEX-L (plates).

For the purpose of the present invention, namely to achieve as favourable heat conducting properties as possible, it is desirable that the density of the graphite making up the laminae be as high as possible. It may be advantageous, therefore, to increase the density of the commercially available sheets of flaky graphite by subjecting the sheets, or the laminae cut from them, to a densifying treatment, such as by rolling, before the stacks are formed.

Before the graphite block 13 is formed by stacking the laminae 16, apertures are formed, e.g. punched in the laminae to allow for reception of the coolant tubes 15. The size of the apertures should be accurately matched with the size of the coolant tubes 15 so that a snug fit of the tubes in the apertures is achieved. Such a fit is essential to obtain an efficient heat transfer from the graphite to the liquid coolant flowing in the coolant tubes.

Figure 3:
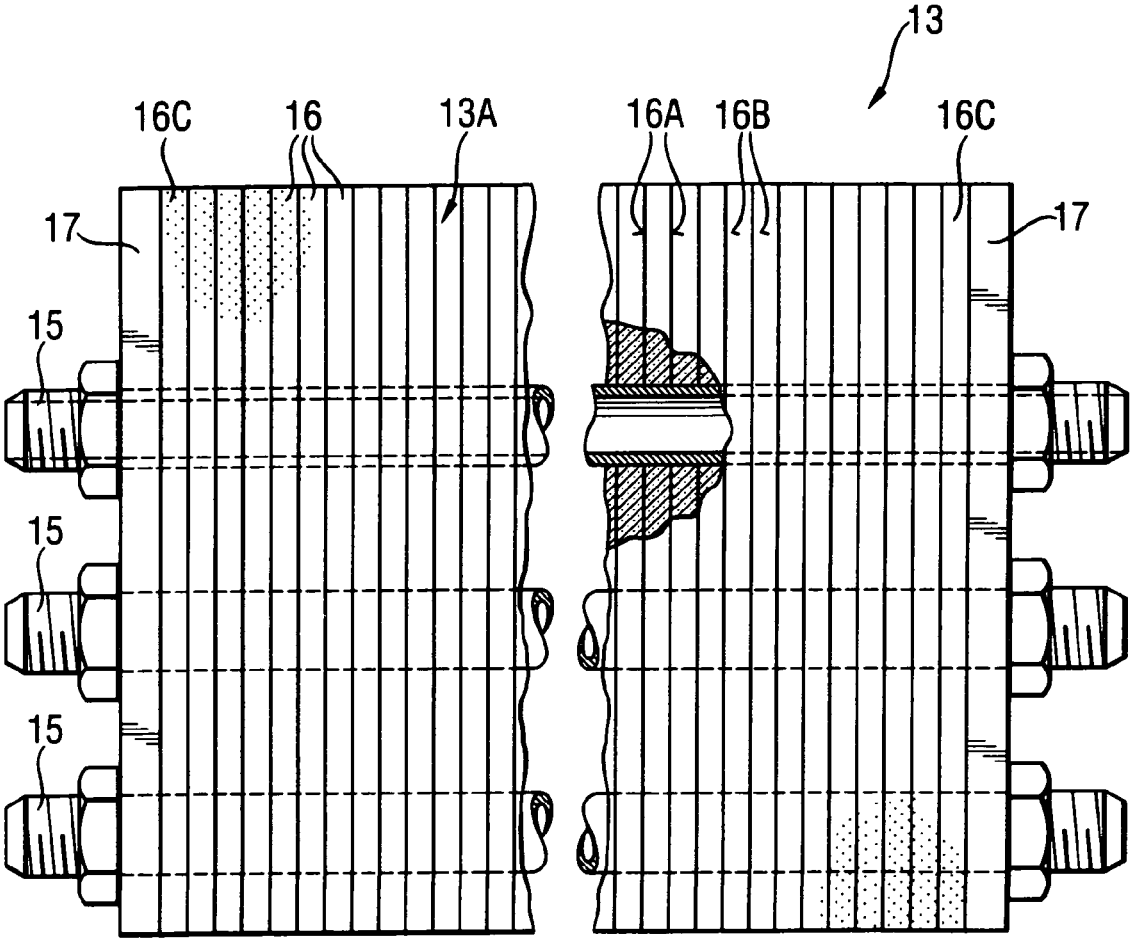
FIG. 3 is a fractional elevational view of one of the two graphite blocks which form essential parts of the mould shown in FIG. 1.

A convenient procedure for forming the stack from the apertured laminae 16 is to secure one end of the coolant tubes 15 to an end member 17, preferably a rectangular plate of approximately the length and width of the laminae 16 (see FIG. 3 where the thickness of the lamina is exaggerated in the interest of clarity), such that the tubes extend in accurately parallel relation, and then sliding the laminae 16 over the opposite ends of the tubes and pushing them along the tubes until they are in face-to face engagement with one another. When all laminae 16 required to form the stack have been added, a similar end member 17 is applied to the stack and pressure is applied in opposite directions through the end members to compact the stack and the laminae 16 forming the stack.

Such compaction enhances the contact of the lamina with the coolant tubes 15 and thereby promotes the heat transfer from the lamina 16 to the coolant flowing in the tubes.

Following the above-described assembly of the graphite block 13 with the coolant tubes 15 accommodated in it, the large faces 13A, 13B of the graphite block are machined, such as by milling, so that the graphite block is reduced to the proper accurate dimensions and will have smooth surfaces. The so finished block is then mounted to its backing plate and installed in the casting machine. The plate-like end members 17 shown in the drawings, which engage the outer faces of the end or outermost laminae 16C (FIG. 3) of the stack, may form parts of or be joined with housings (not shown) in which the ends of the coolant tubes 15 received in the end members are connected to suitable means for passing the coolant through the coolant tubes.

As described above, the confronting faces 13A of the graphite blocks 13 form parts of the walls of the mould cavity C. It is within the scope of the invention, although not preferred, to line the graphite blocks 13 with thin, e.g. 3 mm thick lining plates of graphite.

Although the graphite block 13 is illustrated and described as a component of a continuous-casting mould, its applicability as a cooling device extends to other applications. Accordingly, the cooling device formed by the graphite block 13 is within the scope of the invention as claimed independently of its use in a particular application, whether in the metal-processing field or otherwise.

The invention claimed is:

1. A mould for continuously casting metal strips, comprising a pair of mould side walls on opposite sides of an open-ended mould cavity having an entrance end for continuously receiving molten metal and an exit end for continuously discharging a moving solidified strip formed from the molten metal, each said mould side wall including a graphite block and a cooling system including coolant tubes, wherein the graphite block of each of said mould side walls is formed of a stack of a multiplicity of elongate graphite laminae having opposite faces and inner edges, said inner edges jointly forming a graphite surface directed toward the mould cavity, and wherein each elongate graphite laminae has one or more apertures through which said coolant tubes are received such that the coolant tubes extend through the stack transversely to said opposite faces of the graphite laminae forming the stack.

2. A continuous-casting mould as claimed in claim 1, including a pair of metal end members in face-to-face engagement with the outer face of respective ones of the two outermost graphite laminae of the stack, the coolant tubes being received in said end members.

3. A continuous-casting mould as claimed in claim 1, wherein the graphite laminae of each stack are oriented such that their inner edges extend between the entrance and exit ends of the mould cavity, the coolant tubes extending transversely of the direction of movement of the strip discharging through the exit end of the mould cavity during operation of the mould.

4. A continuous-casting mould as claimed in claim 1 wherein a pair of opposed end walls of the mould cavity are formed by a pair of graphite bars bridging the gap between said side walls along the ends of the stacks of graphite laminae.

5. A continuous-casting mould as claimed in claim 1 including for each of said mould side walls a mould cavity lining member formed of a thin graphite plate supported by said stack of laminae.

6. A continuous-casting mould as claimed in claim 1 including for each stack of graphite laminae a stack-supporting plate substantially coextensive with the stack.

7. A continuous-casting mould as claimed in claim 1 wherein said graphite laminae are made of compacted graphite flakes oriented so as to be generally parallel to said opposite faces of the graphite laminae.

* * * * *